US005458671A

United States Patent [19]

Butler et al.

[11] Patent Number: 5,458,671

[45] Date of Patent: Oct. 17, 1995

[54] SUPPRESSION OF FUME IN METAL POURING

[75] Inventors: G. D. H. Butler, Windlesham; P. L. Purnell, Guildford, both of Great Britain

[73] Assignee: Multiserv International PLC, London, Great Britain

[21] Appl. No.: 182,873

[22] Filed: Jan. 14, 1994

[30] Foreign Application Priority Data

Nov. 11, 1991 [GB] United Kingdom ..... 9123943
Mar. 5, 1992 [GB] United Kingdom ..... 9204764

[51] Int. Cl.[6] ..... B22D 41/00; C21C 5/38

[52] U.S. Cl. ..... 75/584; 266/45; 266/158; 266/230; 222/590

[58] Field of Search ..... 266/44, 45, 275, 266/236, 230, 165, 158, 232, 151, 144; 75/584, 509; 222/590

[56] References Cited

U.S. PATENT DOCUMENTS

| | | | |
|---|---|---|---|
| 2,568,525 | 9/1951 | Waddington | 266/236 |
| 4,097,032 | 6/1978 | Mauritz | 266/230 |
| 4,290,588 | 9/1981 | Pelton | 266/230 |
| 4,546,907 | 10/1985 | Kemble | 222/590 |
| 5,236,346 | 8/1993 | Stonecliffe | 266/275 |

FOREIGN PATENT DOCUMENTS

| | | |
|---|---|---|
| 356688 | 5/1980 | Austria . |
| 0289295 | 11/1988 | European Pat. Off. . |
| 1129402 | 1/1957 | France . |
| 2133455 | 12/1972 | France . |
| 1948678 | 11/1976 | Germany . |

OTHER PUBLICATIONS

Schwarzmaier Dec. 1957 Stranggiessen, Berliner Union (Stuttgart) pp. 57, 173, 174 (with English Translation).

Fuji Denki Seizo Oct. 8, 1981 Patent Abstracts of Japan, vol. 6, No. 4, M-106 abstract of JP, A, 56-128667.

*Primary Examiner*—Scott Kastler

*Attorney, Agent, or Firm*—Caesar, Rivise, Bernstein, Cohen & Pokotilow, Ltd.

[57] ABSTRACT

Molten (M) is poured into a receiver (8,28) designed to reduce fume and then out into an open area (P) via an outlet (9,29) designed to cause the metal (M) to flow in a laminar flow. A hood (11) may be present above the receiver (8,28).

15 Claims, 4 Drawing Sheets

SUPPRESSION OF FUME IN METAL POURING

The invention relates to the suppression of fume arising during pouring metal from a container in air or like atmosphere, for example, to the suppression of fume arising when pouring liquid iron from a torpedo or like container into a pond or lagoon at a steelworks.

BACKGROUND OF THE INVENTION

1. Field of the Invention

Liquid iron is transported in torpedoes on railways or roadways at a steelworks from one work station to another, e.g. from an iron making furnace to a steel making furnace. From time to time there are hold-ups and it is not economic to keep the metal liquid in the container until it can be accepted at the receiving station. It is usual to move the torpedo to an open area called a pond and to pour the liquid metal from the torpedo into the pond where it solidifies; the solid metal is later broken up, recovered and remelted when required or sold to third parties. When the metal is poured into the pond it will oxidise on exposure to the air and this creates vast quantities of fume, mainly iron oxide, which is environmentally unacceptable. It is one object of the invention to provide a method and apparatus useful in the pouring of molten metal so that this problem is reduced or eliminated.

We have analysed the causes of the evolution of the fume and have established that the main factor is the splashing which takes place when the liquid metal is poured. We have discovered that if the molten metal is poured into a receiver as indicated herein such fume as is evolved may be removed via a hood extraction system or where the suppression is sufficiently good a hood system can be dispensed with.

SUMMARY OF THE INVENTION

According to the invention in one aspect there is provided a method of pouring liquid metal from a container, the method comprising (i) pouring the metal from the container into a receiver therefor, the receiver being shaped so as to maintain a height of liquid metal therein thereby to reduce the evolution of fume, and (ii) passing the liquid metal from an outlet of the receiver in a substantially laminar flow to an open area at which the liquid metal is allowed to solidify.

It is a much preferred feature of the invention that the outlet is present in a sidewall of the receiver and is disposed sufficiently high above the floor of the receiver that a bath of liquid metal is present whereby further liquid poured into the receiver will enter the bath of liquid metal which will reduce the risk of splashing which is a major cause of the evolution of fume. Preferably the outlet is about 250 mm. to about 350 mm. above the floor to create a height of liquid metal in the receiver. If the outlet is higher, then there will be much splash when the liquid metal is first poured and much fume will be generated when one remelts residual solidified metal left after one pouring and the next pouring starts. If the outlet is lower there will be excess erosion of the floor of the box. The dimensions may vary dependent on the nature of the liquid metal being poured. Preferably a channel or launder extends from the outlet to the open area. It is preferred that the receiver, which is typically a box-like structure, and the channel are formed of cast refractory material.

Optionally, the method includes the step of surrounding the receiver area with an inert gas which suppresses combustion, and the launder may be enclosed by an overlying cover.

Typically the liquid metal is iron and the fume arising includes particles of iron oxide; the container is a torpedo and the open area is a pond or lagoon at a steelworks.

In another aspect the invention includes a pour station comprising a box shaped structure having a floor and side walls, the structure being cast of refractory material, an outlet port being present in one side wall, the port being sufficiently high up the side wall that a bath of liquid metal is present in the box whereby molten metal poured into the box enters the liquid metal so reducing the generation of fume, and then caused to flow out of the box through the port in a laminar flow. Preferably the station includes a channel in line with the port, leading to the area.

In one specific aspect the invention provides a method of pouring liquid metal from a container into a receiver and thence to an open area, the method comprising (i) pouring the metal from the container into a receiver above which is a hood, the hood being the inlet end of a fume extraction system, the fume arising from the pouring being extracted via the hood, and (ii) passing the liquid metal from the receiver in a substantially laminar flow to the open area at which the liquid metal is allowed to solidify.

Most preferably the hood is spaced from the receiver by a distance selected to draw a draught of air into the receiver and hence into the extraction and gas cleaning system, which may include a baghouse filter system having an air extraction fan or a scrubber. Most preferably the hood is connectable to one of a number of spaced apart ports of an elongate duct system leading to the baghouse, and alongside the pond. It is preferred to so design the receiver that the fume suppression is efficient so that the hood and associated dust extraction system are eliminated to avoid a large capital investment.

In one aspect the invention includes apparatus for use in controlling the release of fume when pouring liquid metal from a container, the apparatus comprising a mobile hood connectable to a fume extraction system the hood having four side walls defining an open mouth, the roof of the hood being connected to ducting connectable to a baghouse having a filter system, side portions of the hood being shaped to form a seal with walls of the container.

In another aspect the invention includes a fume extraction system comprising a baghouse having a filter system and a fan, the baghouse being connected to an elongate duct having longitudinally spaced apart ports which can be closed or connected in a gas tight manner to the outlet of a fume extraction conduit, the remote end of which comprises a hood.

In yet another aspect the invention includes a pour station comprising a box shaped structure having a floor and side walls, the structure being cast of refractory material, a port being present in one side wall, whereby molten metal poured into the box is agitated therein and then caused to flow out of the box through the port in a laminar flow. Preferably the station includes a channel in line with the port.

BRIEF DESCRIPTION OF THE DRAWING

In order that the invention may be well understood it will now be described by way of example only with reference to the accompanying diagrammatic drawings, in which.

Figure 1:
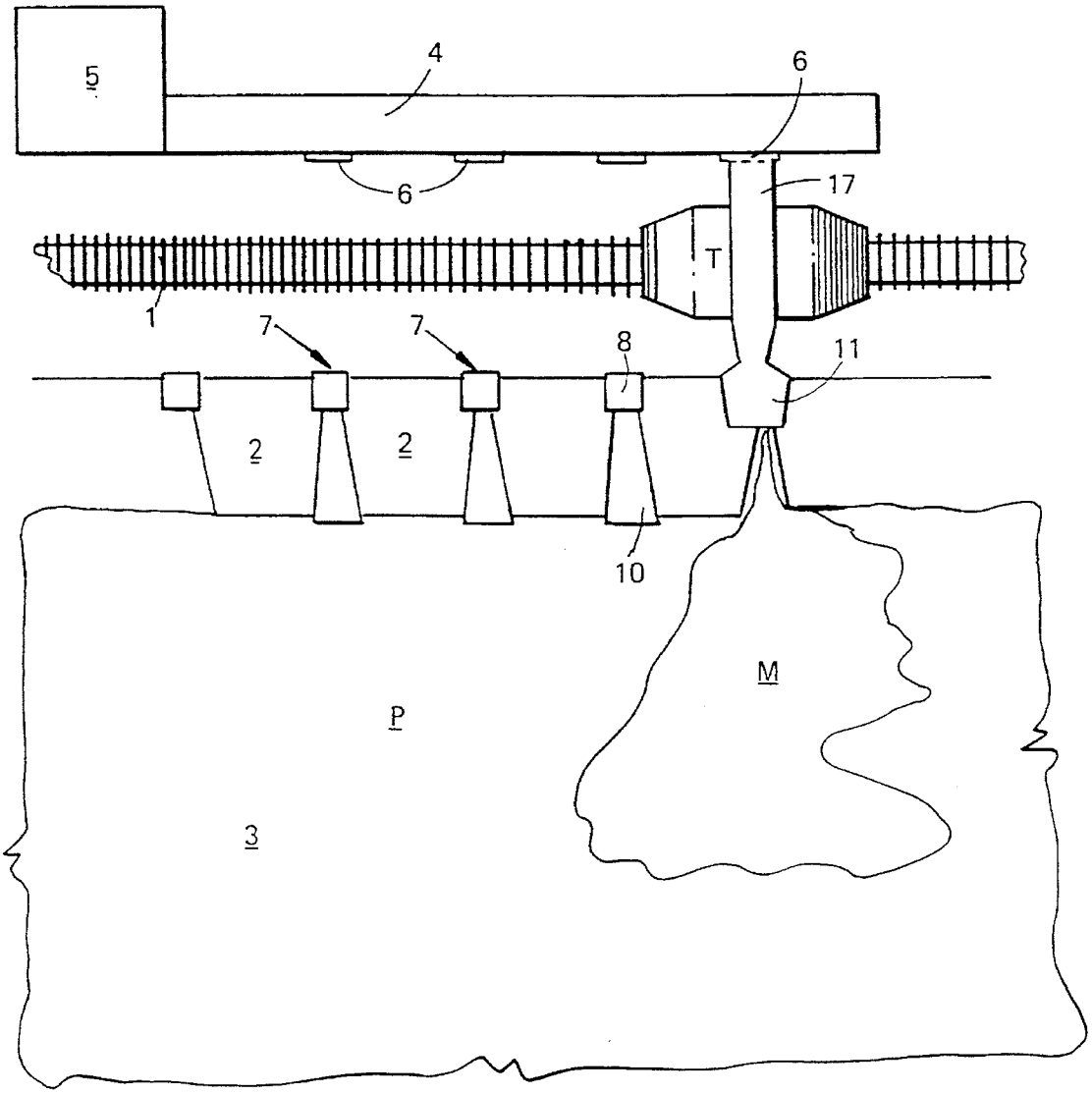
FIG. 1 is a partial plan view of a steelworks pond area including one apparatus of the invention.
Figure 2:
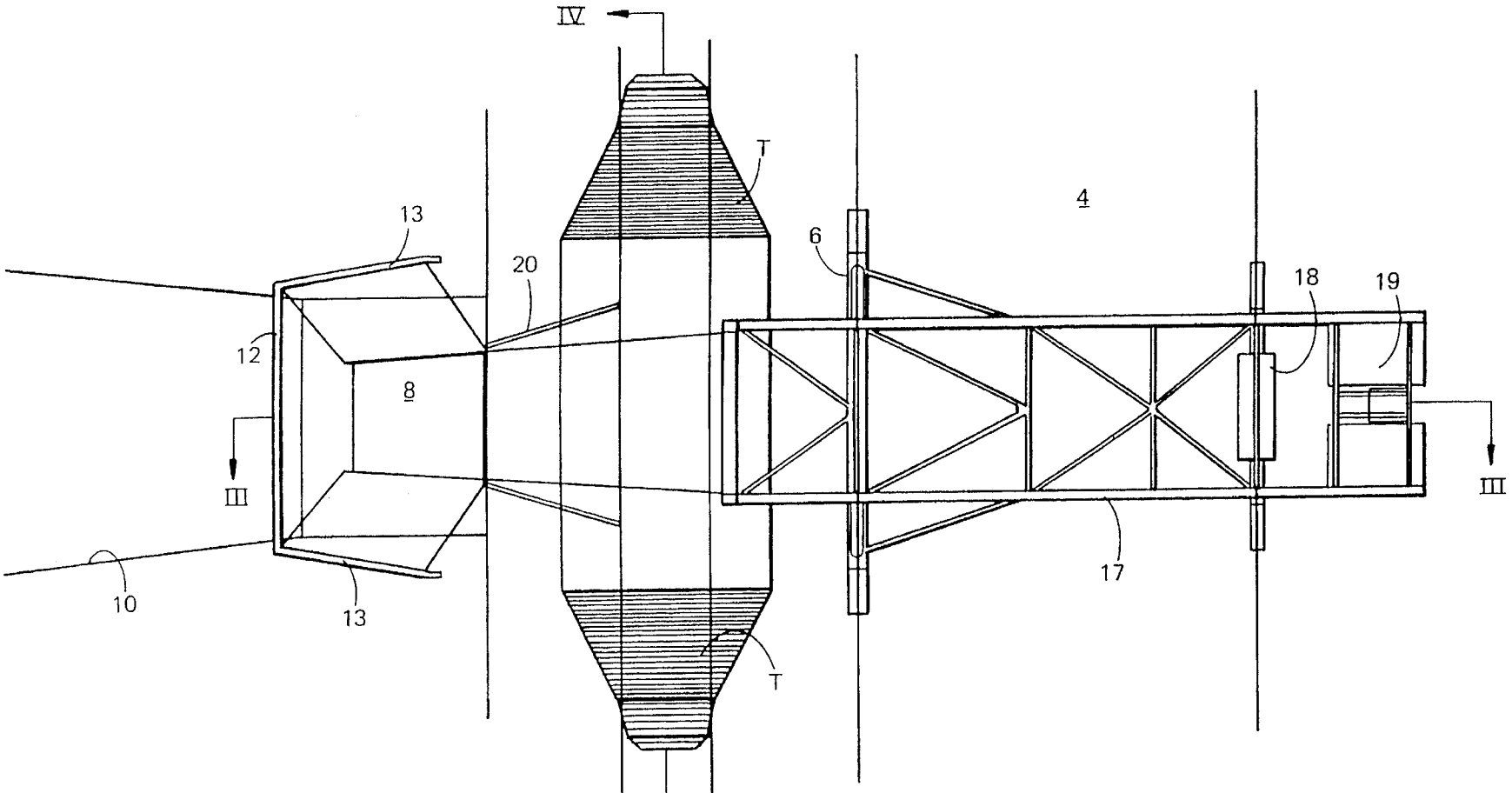
FIG. 2 is an enlarged plan view of the apparatus of FIG.
Figure 3:
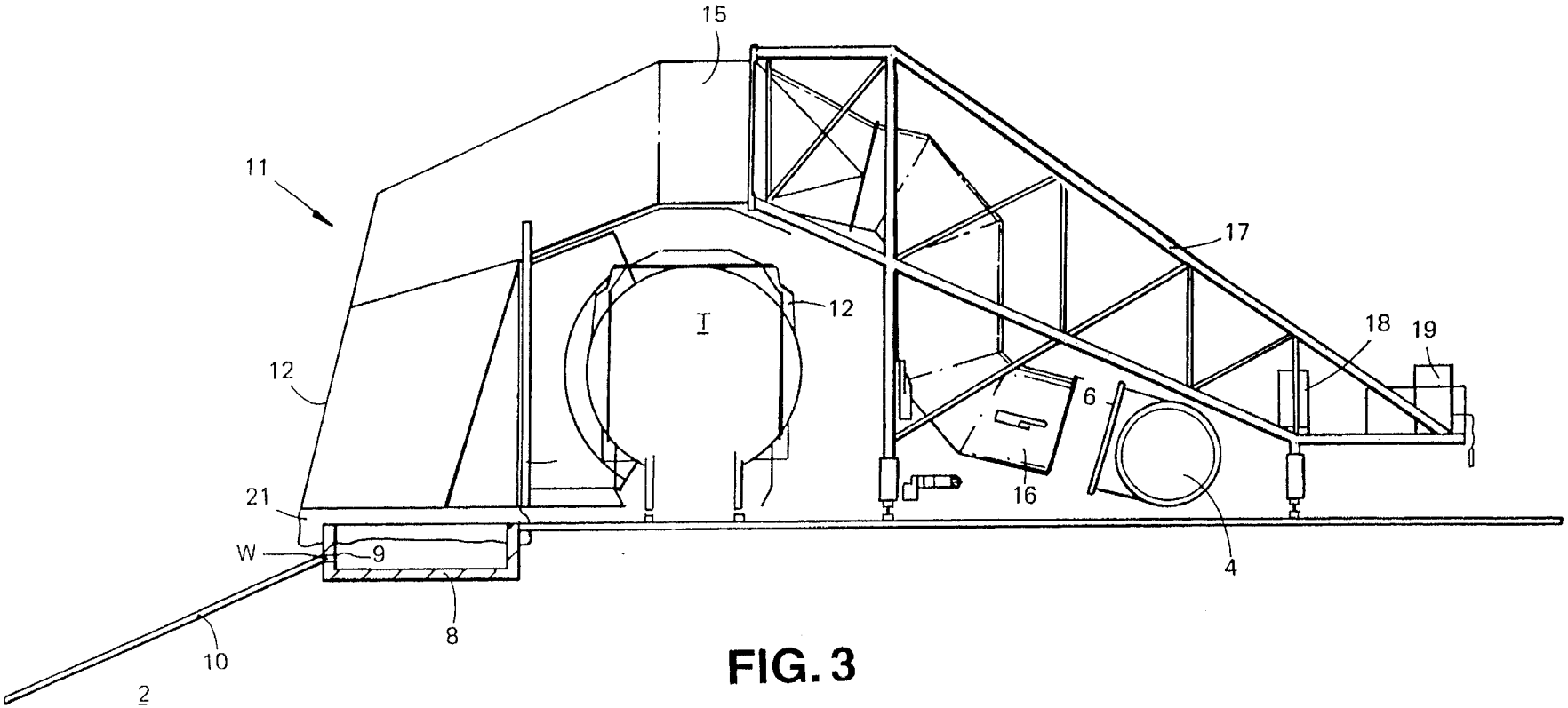
Figure 4:
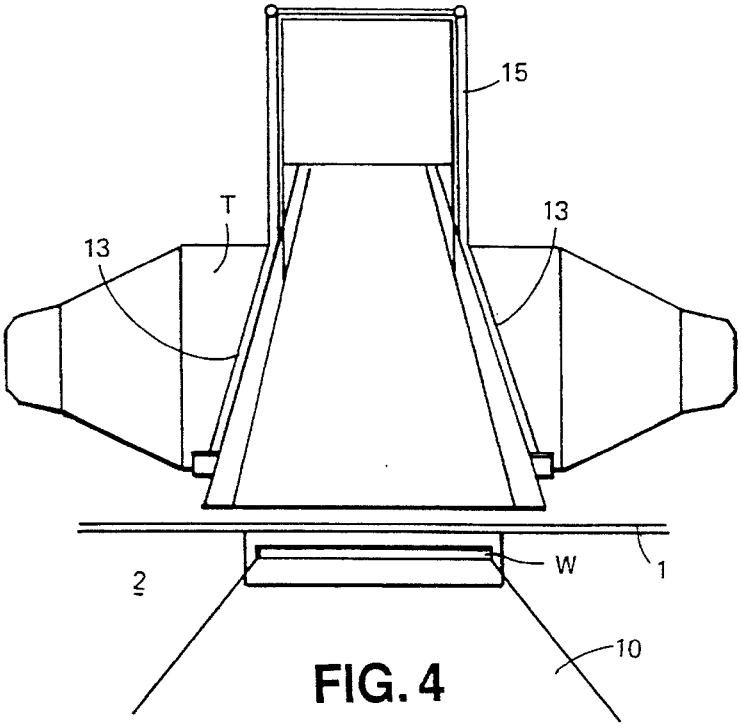
Figure 5:
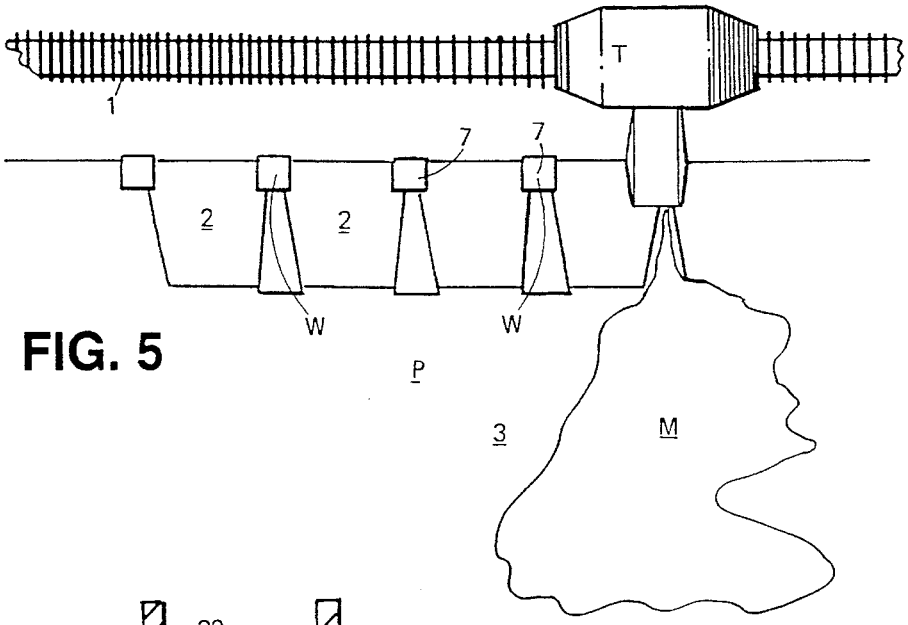
Figure 6:
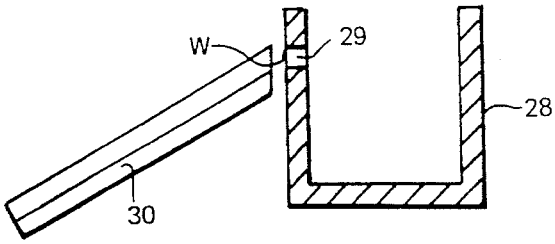

1;

FIG. 3 is a longitudinal sectional view taken on lines III—III on FIG. 2;

FIG. 4 is a transverse sectional view taken on lines IV—IV on FIG. 2;

FIG. 5 is a partial plan view of a steelworks pond area including a second apparatus of the invention; and FIG. 6 is a vertical sectional view of the box shown in FIG. 5.

DETAILED DESCRIPTION OF THE PREFERRED EMBODIMENTS

As shown in FIGS. 1 to 4, a rail track 1 leads to a large pond or lagoon area P having sloping walls 2 and a generally flat base 3. The area of the pond P will vary, but is usually sufficient to hold 10,000 to 20,000 Te of liquid iron as a layer. A duct system 4 extends generally parallel to the rail track 1 and ends at a baghouse 5 containing a filter system and an extraction fan, not shown. Tap off ports 6 are present at spaced apart locations along the length of the duct 4 and pour stations 7 are present in alignment with the tap off ports 6 on the duct 4. Each pour station 7 is set in the side wall 2 of the pond P. The station 7 comprises a box like portion 8 which, as shown in FIG. 3, has in the wall adjacent the pond base 3 a generally horizontal slit 9 defining a port or weir W which leads to a downwardly sloping channel 10. The box and the channel are formed of cast sintered refractory material.

A mobile hood 11 is located over a selected pour station 7. The hood comprises a generally rectangular chamber defined by a sloping front wall 12, two sloping side walls 13 and a generally vertical rear wall 14. The upper end of the hood 11 communicates with a duct 15 which leads in arch fashion down to a connection piece 16 shaped to connect with a selected port 6. The duct 15 is held in frame work 17 which supports the hood system 11 and runs on a track generally parallel to the rail track 1, powered by a motor 18 and controlled from a panel 19. The hood has side flaps 20 which are shaped so that in use they lie alongside the mouth of the torpedo T. As shown in FIG. 3, the hood may have side flaps 21.

In use when it is necessary to store molten metal, e.g. liquid iron in the pond P, a locomotive brings the torpedo T to a selected pour station 7. The hood 11 is moved to the station and the connection piece 16 is connected to the respective port 6 of the duct system 4, and the fan thereof switched on to cause air to be drawn from the hood 11 towards the baghouse 5, the size of the draught, i.e. the air flow rate, being determined by the vertical distance between the lower edge of the hood 11 and the box 8. An air flow of about 2 to 20 meters/sec, preferably about 5 meters/secs is desirable to ensure capture of the fume, smoke, dust and gas and pass it to the baghouse 5.

The torpedo T is rotated on its frame to pour the liquid iron into the box 8 at the pour station 7. The metal hits the floor of the box 8 and is agitated, mixing with the oxygen in the air to form fume which rises into the hood 11 and is immediately removed to the duct 4 and thence to the baghouse 5 where it is filtered in known manner. The molten metal flows out of the box 8 via the weir W into the channel 10 by which time it has taken up a laminar flow and as a result is little oxidised so that little or no further fume is produced as the metal M flows on to the base 3 and solidifies to form a layer or crust. The pouring into the box 8 is intended to produce maximum turbulence and fume emission to optimise extraction within the hood 11. The trajectory of liquid iron into the box 8 will vary, but it is preferred that the impact of the stream should be towards the wall having the slit 9. Residual metal will be left in the box 8 will solidify but will remelt on the next pour. The side flags 20 provide a seal between the hood 11 and the sides of the torpedo T.

The same reference numerals are used in describing the embodiment of FIGS. 5 and 6 as were used in describing the first embodiment, where convenient. As shown in FIGS. 5 and 6, the rail track 1 leads to a large pond or lagoon area P having sloping walls 2 and a generally flat base 3. Pour stations 27 are present spaced apart along one side of the pond P. Each pour station is set in the side wall 2 of the pond P. The station 27 comprises a box like structure 28 which, as shown in FIG. 5, has in the wall adjacent the pond base 3 a generally horizontal slit 29 defining a port or weir W which leads to a downwardly sloping channel 30. The box and the channel are formed of cast sintered refractory material. The slit 29 is about 250 mm to 350 mm from the floor of the box 28, so that when molten metal is poured into the box a head of liquid is created.

In use when it is necessary to store molten metal, e.g. liquid iron in the pond P, a locomotive brings the torpedo T to a selected pour station 27. The torpedo T is rotated on its frame to pour the liquid iron into the box 28 at the pour station 27. The first metal hits the floor of the box 28 and forms a head of liquid into which following metal flows with little or no evolution of fume. The molten metal flows out of the box 28 via the weir W into the channel 30 by which time it has taken up a laminar flow and as a result is little oxidised so that little or no further fume is produced as the metal M flows on to the base 3 and solidifies to form a layer or crust. Residual metal will be left in the box 27 will solidify but will remelt on the next pour.

From time to time the mouth of the torpedo is freed of adherent solidified metal, e.g. using a hydraulic hammer.

The invention is not limited to the embodiment shown. The box need not be of rectangular cross sectional shape. The upper walls of the box may have a rim or ledge, and the walls may be inclined. Auxiliary gas pipework may be present in the hood or alongside the box to supply inert or combustible gas, e.g. $CO_2$, methane, town gas. The channel 30 may have a roof. The extraction system may include a water bath or seal. The metal poured need not be liquid iron, and the vessel need not be a torpedo; the vessel need not move along a rail track. A cover may be present above the open area.

We claim:

1. A method of dumping liquid metal from a container in an open area exposed to the atmosphere while suppressing the amount of fume produced by the pouring of the liquid metal when the liquid metal contacts air in the atmosphere, the method comprising the steps of:

(i) pouring the metal from the container into a receiver, the receiver having an outlet in a sidewall thereof, the receiver and outlet being dimensioned so that the pouring of the container provides a height of liquid metal in the receiver before liquid metal can flow through the outlet, said height of liquid metal being maintained while (ii) passing the liquid metal in a substantially laminar flow through the outlet into the open area comprising a generally amorphously-shaped open pond or lagoon of the liquid metal in that area to allow the liquid metal to solidify.

2. A method according to claim 1, in which the receiver (8,28) comprises a receiver structure one side wall of which defines a port (9,29), the liquid metal being caused to flow through the port in a laminar flow.

3. A method according to claim 1 or 2, wherein the outlet (9,29) is spaced from the floor of the receiver (8,28) by a vertical distance which is sufficient to create a bath of molten liquid.

4. A method according to claim 1 or 2, wherein a channel (17,27) a launder, extends from the port to the area (P) at which the liquid metal is allowed to solidify.

5. A method according to claim 4, wherein the receiver (8,28) and the channel (10,30) are formed of cast refractory material.

6. A method according to claim 1 or 2, including the step of surrounding the receiver with a gas which suppresses combustion.

7. A method according to claim 4, wherein the channel (10,30) is provided with an overlying cover.

8. A method according to claim 1, 2 or 7, wherein the liquid metal is iron and the fume arising includes particles of iron oxide.

9. A method according to claim 1, 2 or 7, wherein the container (T) is a torpedo container and the area (P) is a pond or lagoon at a steelworks.

10. A dumping station for use when dumping liquid metal from a container into an open area, the station comprising a receiver to receive liquid metal from said container and from which the liquid metal can flow into said open area to form a pond or lagoon, the receiver comprising a box-shaped structure having a floor and side walls, the structure being cast of refractory material, an outlet port being present in one side wall, the port being the sole outlet for the receiver, the port being located sufficiently high up the side wall so that a bath of correspondingly deep liquid metal is created in the box before the molten metal can pour out of the box, whereby when molten metal is poured into the box it contacts liquid metal and forms a bath thereof which then flows out of the box through the port in a laminar flow into the open area to form a generally amorphously-shaped pond or lagoon whereby production of fume caused by contact of the metal and air is reduced.

11. A dumping station according to claim 10, including a channel (10,30) in line with the port (9,29).

12. A method according to claim 1, 2 or 7, 10 or 11, including locating a hood (ii) over the receiver, the hood (11) being connected to a fume extraction system (5).

13. Apparatus for use in controlling the release of fume produced when dumping liquid metal from a container in the presence of air, the apparatus comprising a mobile hood which is connected via a mobile duct to a fume extraction system having an inlet and an outlet, the hood having four side walls and a roof defining an open mouth, the roof of the hood being connected via a mobile duct to a generally elongate duct system comprised of longitudinally spaced apart ports which can be closed or connected in turn in a gas tight manner to the outlet of the fume extraction system which is connected to a baghouse having a filter system, wherein the side portions of the hood are shaped to form a seal with walls of the container and the apparatus including a series of pour stations, one corresponding to each of said ports, whereby when metal is poured from said container at one of said pour stations, said one pour station can be connected by said mobile hood and mobile duct to its corresponding port.

14. A fume extraction system comprising a baghouse (5) having a filter system and a fan, the baghouse (5) being connected to an elongate duct (15) having longitudinally spaced apart ports (6) which can be closed or connected in a gas tight manner to the outlet of a fume extraction conduit, the remote end of which comprises a hood (11).

15. A system according to claim 13, wherein the baghouse (5) is replaced by a scrubber.

* * * * *